United States Patent [19]

Reiter

[11] Patent Number: 4,944,128

[45] Date of Patent: Jul. 31, 1990

[54] HAND SANDER WITH AUTOMATIC SLACK TAKE-UP FEATURE

[76] Inventor: John P. Reiter, 10407 Quebec Ave. S., Bloomington, Minn. 55438

[21] Appl. No.: 377,113

[22] Filed: Jul. 10, 1989

[51] Int. Cl.[5] ..... B24D 15/08

[52] U.S. Cl. ..... 51/363; 51/392

[58] Field of Search ..... 51/390, 391, 392, 393, 51/363, 372, 358, 389; 29/78, 80

[56] References Cited

U.S. PATENT DOCUMENTS

| | | | |
|---|---|---|---|
| 2,809,476 | 10/1957 | Bourdunis | 51/392 X |
| 3,123,947 | 3/1964 | Rawley | 51/392 X |
| 3,531,841 | 4/1968 | McCord, Jr. | 29/80 X |

*Primary Examiner*—Frederick R. Schmidt
*Assistant Examiner*—Bruce P. Watson
*Attorney, Agent, or Firm*—Haugen and Nikolai

[57] ABSTRACT

A hand sander for finishing both planar and arcuate surfaces is disclosed which provides a means whereby the flexible abrasive strip is shifted relative to a backup member so that it remains taut irrespective of whether a planar surface, a concave surface or a convex surface is being finished. The base or backup member comprises an elongated flexible strip having hand grips mounted thereon. Loosely coupled to the backup member is a further strip of flexible material having means for clamping opposed ends of the abrasive strip. First and second pairs of cooperating wedges are affixed to the base member and the clamping strip so as to cooperate with one another so as to effect the degree of displacement between the base and clamping member as the base member is passed over an arcuate surface to be finished.

6 Claims, 1 Drawing Sheet

HAND SANDER WITH AUTOMATIC SLACK TAKE-UP FEATURE

BACKGROUND OF THE INVENTION

I. Field of the Invention

This invention relates generally to a hand tool for smoothing or finishing the surface of a workpiece, and more particularly to a hand sanding apparatus for supporting a flexible strip of abrasive sheet material thereon and which can be flexed to conform to arcuate surfaces while maintaining the abrasive sheet in a taut condition.

II. Discussion of the Prior Art

In the manufacture and repair of a variety of products, it is necessary to sand or abrade the product to a desired degree of smoothness. For example, in automobile body and fender repair or in the repair of boat hulls and the like, dents, gouges and other imperfections are first filled with an appropriate filling material and then, once hardened, the surface is sanded smooth prior to painting. Likewise, in the refinishing of certain furniture items, following the removal of the old finish, it is common practice to sand the piece to remove any dents, depressions or gouges in the wood prior to its being restained and revarnished.

The hand sanding operation of plane surfaces is often facilitated by using a sanding block. Most prior art sanding blocks are rigid and include a planar surface over which the sandpaper or other abrasive sheet is wrapped. The block may also include a handle for facilitating the gripping thereof during use. While a flat, rigid sanding block may be satisfactory for treating or finishing a planar surfaces, e.g., a tabletop, it is wholly unsuitable for finishing contoured surfaces.

In treating contoured surfaces, it has been the practice in the past for the user to merely grip the abrasive sheet in his or her hand and use the palm of the hand and the fingers as the backup for the sandpaper. In many instances, the end results are unsatisfactory because of irregularities or waves in the workpiece resulting from the application of uneven pressure during the sanding process.

Ideally, for smoothly contoured surfaces of fairly large radius of curvature, a flexible backup member for the abrasive sheet might produce satisfactory results, but this approach presents difficulty when it is considered that the abrasive sheet is inelastic and, therefore, unable to extend and contract as the backup member is flexed to conform to the contours of the surface being abraded. When sanding a convex surface, the backing member must flex to a concave condition, thus leaving the abrasive sheet draped over it in a loose-fitting manner. When sanding a concave surface, on the other hand, the backing member must flex to a convex orientation and the degree to which flexure is permitted is determined by the span between the sandpaper clamps used to secure the sandpaper to the backup member.

SUMMARY OF THE INVENTION

It is accordingly a principal object of the present invention to provide an improved hand sanding apparatus for use in finishing planar, concave and convex workpieces.

Another object of the invention is to provide a hand sander having a flexible backup member for supporting the abrasive sheet along with mean for lengthening and shortening the effective length of the abrasive sheet material when traversing curved surfaces.

A further object of the invention is to provide a hand sanding apparatus for use with both planar and curved surfaces which is simple in construction, inexpensive to manufacture, yet effective.

The foregoing features, objects and advantages are achieved by providing a hand sanding apparatus having an elongated flexible backup member with hand grip means affixed to one major surface thereof. The other major surface of the backup member is arranged to abut the paper or fabric side of the abrasive sheet. Mounted on the first major surface and straddled by the hand grip members is a sandpaper clamping bar which is generally coextensive in length with the length of the backup member and which is loosely coupled thereto by virtue of being straddled by the hand grip members. Affixed to opposed ends of the clamping bar are means for gripping the opposed ends of the abrasive sheet. Disposed between the backup member and the clamping bar, proximate the opposed ends of each are mating wedges having inclined surfaces cooperating with one another. When an abrasive sheet is clamped in place and draped across the surface of the backup member, it remains taut even when traversing concave or convex surfaces because of the manner in which the clamping bar is made to ride up and down relative to the backup member due to the cooperation of the wedges.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 2:
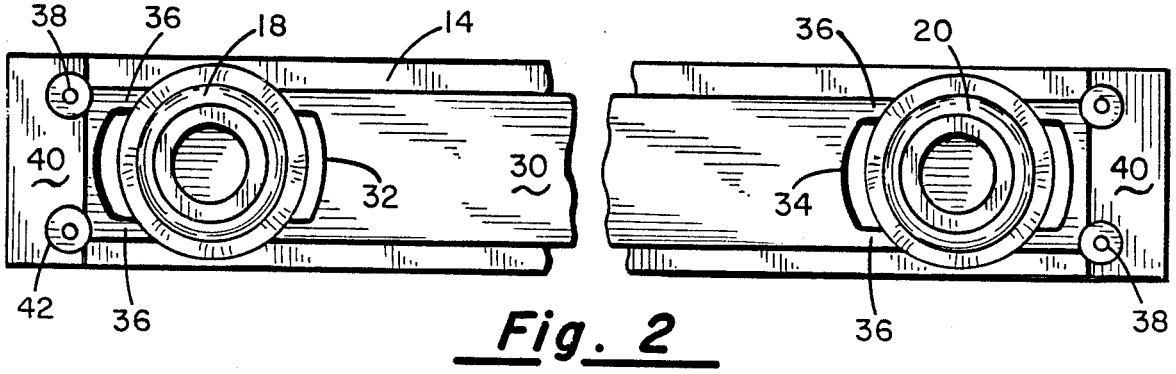
FIG. 2 is a top view of the device of FIG. 1.
Figure 1:
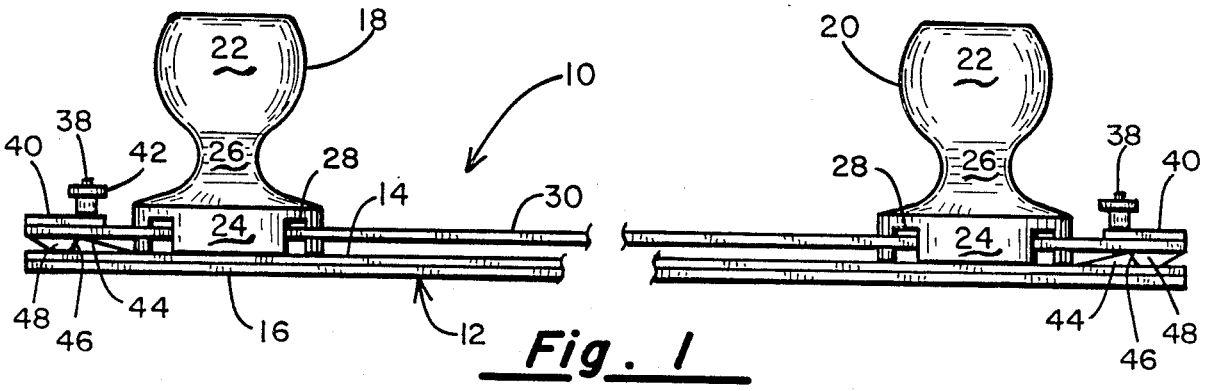
FIG. 1 is a side elevation of the hand sanding apparatus of the present invention.

Referring to FIGS. 1 and 2, the hand sander of the present invention is identified generally by numeral 10 and is seen to include an abrasive sheet backup member 12 which preferably comprises an upper flexible strip 14 laminated with a lower strip 16 of elastomeric material. The strip member 14 may be fabricated from a variety of materials including spring steel, aluminum or plastic, with a polycarbonate plastic, such as sold under the trademark, LEXAN®, being preferred because of its strength characteristic. The elastomeric sheet 16 is preferably NEOPRENE®, but other materials such as foam rubber may be used as well. The member 16 provides a relatively non-slip surface between the flexible backup member 14 and the abrasive sheet (not shown) with which it contacts. Affixed proximate the opposed ends of the hand sander apparatus 10 are hand grip members 18 and 20 having knob-like grips 22 supported from integrally formed pedestals 24 by necked down segments 26. The pedestals 24 include grooves as at 28 which extend parallel to one another.

Resting atop the flexible base member 12 is an abrasive sheet clamping bar 30 which, like the strip 14, may be fabricated from metal or plastic with LEXAN polycarbonate plastic being preferred. The clamping bar 30 is sufficiently thin that it may readily flex. Formed through the thickness dimension thereof are cutouts as at 32 and 34 which define thin narrow strips 36 which pass through the grooves 28 formed in the pedestals 24 of the hand members 18 and 20. Thus, it can be seen that the pedestal portion 24 of the hand grip members straddle the sandpaper clamping bar 30 to limit lateral movement thereof relative to the base member but allowing longitudinal displacement. The pedestals 24 are fastened to the backup member 12 by an adhesive or other suitable fastener extending through the base strip 14 and into the hand grip member.

In FIG. 1, there is shown extending upward from the sandpaper clamping bar 30 screws 38 which pass through holes drilled in plates 40. Knurled nuts, as at 42, when loosened on the screws 38 allow the plates 40 to be lifted relative to the clamping bar 30 to allow the end portions of an abrasive strip to be inserted therebetween. Then, when the nuts 42 are again tightened, the abrasive strip is effectively clamped in place with the working surface of the abrasive strip being wrapped about the elastomeric layer 16 of the backup member 12.

Referring again to FIG. 1, there is shown secured to the upper major surface of the backup strip 14, a wedge member 44 having an inclined surface 46. The wedge member 44 may also be fabricated from LEXAN plastic and bonded to the strip 14.

In a similar fashion, extending downward from the undersurface of the clamping bar 30 is a mating wedge 48. It, too, has an inclined ramp surface riding on the ramp surface 46.

Figure 3:
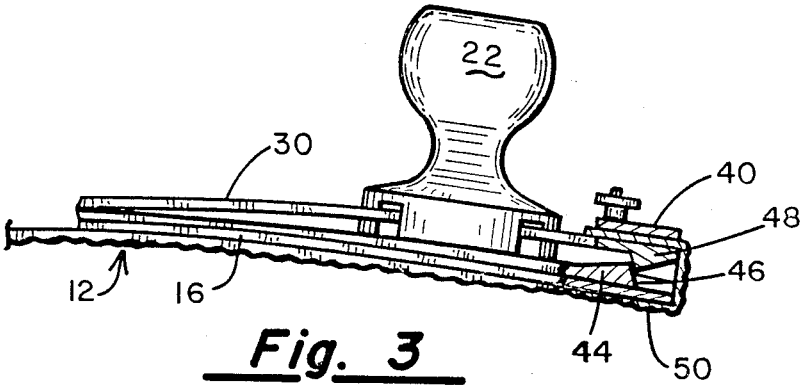
FIG. 3 is a sectional view showing the cooperation between the backup member and clamping member when traversing a convex surface.

Referring to FIG. 3, there is shown an abrasive sheet 50 clamped between the plate 40 and the clamping bar 30 and wrapped about the elastomeric layer 16. The base member 12 in FIG. 3 is shown in a flexed condition as it would be when the hand sander is being used to finish a convex curved work surface. It is to be especially noticed how the wedges 44 and 48 ride upon one another to effectively increase the spacing between the clamping bar 30 and the base member 12 proximate the end edges thereof. This takes up the slack which would otherwise exist in the abrasive sheet 50.

Figure 4:
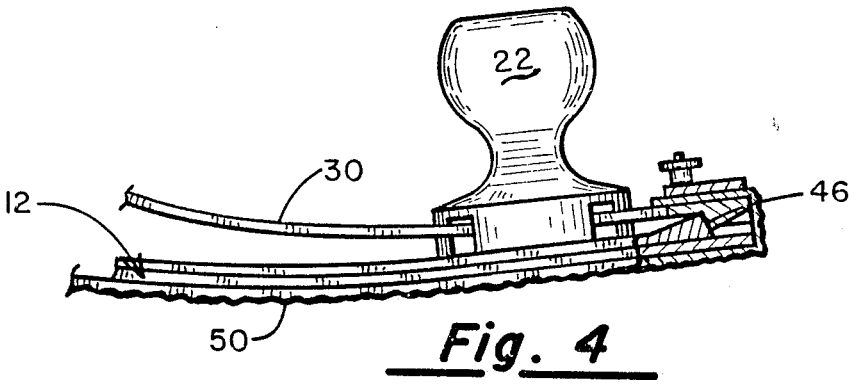
FIG. 4 shows the relationship between the backup member and the clamping member when traversing a concave surface.

Next, with reference to FIG. 4, there is shown the relationship between the parts when the hand sander is being used to finish a convex curved workpiece. Again, attention is directed to the relationship between the wedges 44 and 48 illustrating that the clamping bar 30 has now moved closer to the backup member 12, effectively extending the length of the abrasive sheet 50 so as to allow it to conform to the convex curvature of the backup member 12.

Thus it can be seen that the present invention provides a hand tool for facilitating the finishing by abrasion of a workpiece, be it planar, convex curved or concave curved. The abrasive sheet remains tensioned across the face of the backup member irrespective of the direction of flexure of the backup member because of the manner in which the wedges 44 and 48 are allowed to ride upon one another along the incline surfaces 46.

This invention has been described herein in considerable detail in order to comply with the Patent Statutes and to provide those skilled in the art with the information needed to apply the novel principles and to construct the use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Sanding apparatus for finishing both plane and curved surfaces comprising:

(a) a generally rectangular flexible base member having first and second major surfaces;

(b) hand grip means affixed to said first major surface;

(c) a strip of material sufficiently thin to permit flexure thereof mounted on said base member and overlaying said first major surface and including clamping means disposed at each end of said strip for releasably clamping opposed ends of a flexible generally rectangular sheet of abrasive material with the sheet of abrasive material extending over and backed-up by said second major surface of said base member; and (d) tensioning means disposed between said first major surface of said base strip of material and said means mounted on said base member for maintaining said sheet of abrasive material in contact with said second major surface irrespective of whether said base member is flexed to conform to a convex or a concave curved surface, said tensioning means including a first pair of wedge members affixed to said strip and a second pair of wedge members affixed to said first major surface and located in contact with said first pair of wedge members such that flexure of said base member and said strip results in a change in separation of said strip relative to said base member.

2. The sanding apparatus as in claim 1 wherein said base member comprises a sheet of plastic or metal sufficiently thin to permit flexure thereof.

3. The sanding apparatus as in claim 2 wherein said base member is a lamination of said sheet of plastic or metal and a sheet of elastomeric material adhered thereto, said sheet of elastomeric material including said second major surface.

4. The sanding apparatus as in claim 1 wherein said hand grip means straddle said strip proximate opposed ends of said base member.

5. The sanding apparatus as in claim 1 wherein convex curvature of said second major surface causes said separation to decrease and concave curvature of said second major surface causes said separation to increase.

6. Sanding apparatus for finishing both plane and curved surfaces comprising:

(a) backing means for supporting a strip of abrasive material;

(b) clamping means mounted on a clamping bar means which overlays said backing means for clamping opposed ends of said strip of abrasive material with said strip of abrasive material abutting said backing means; and (c) first and second pairs of cooperating wedges disposed between said clamping bar means means and said backing means for maintaining said strip of abrasive material slack-free when said backing means is flexed.

* * * * *

UNITED STATES PATENT AND TRADEMARK OFFICE

CERTIFICATE OF CORRECTION

ATENT NO. : 4,944,128

ATED : July 31, 1990

IVENTOR(S) : John P. Reiter

It is certified that error appears in the above-identified patent and that said Letters Patent is hereby rrected as shown below:

Column 4, lines 26 and 27, delete "strip of material and said means" and put instead -- member and said strip of material".

Signed and Sealed this

Seventeenth Day of September, 1991

*Attest:*

HARRY F. MANBECK, JR.

*Attesting Officer*

*Commissioner of Patents and Trademarks*